US007752982B2

(12) United States Patent
Lin

(10) Patent No.: US 7,752,982 B2
(45) Date of Patent: Jul. 13, 2010

(54) LATCHING MECHANISM FOR FOLDABLE TABLE

(75) Inventor: Wen-Sheng Lin, Kaohsiung (TW)

(73) Assignee: Maxchief Investments, Ltd. (CN)

( * ) Notice: Subject to any disclaimer, the term of this patent is extended or adjusted under 35 U.S.C. 154(b) by 319 days.

(21) Appl. No.: 11/873,746

(22) Filed: Oct. 17, 2007

(65) Prior Publication Data

US 2008/0072804 A1 Mar. 27, 2008

Related U.S. Application Data

(63) Continuation-in-part of application No. 11/383,776, filed on May 17, 2006, now abandoned, and a continuation-in-part of application No. 10/763,155, filed on Jan. 21, 2004, now abandoned.

(51) Int. Cl.
*A47B 3/083* (2006.01)

(52) U.S. Cl. ..... 108/168; 16/332

(58) Field of Classification Search ..... 108/127, 108/166–175; 292/262–278, 231–232; 16/332, 16/335, 374
See application file for complete search history.

(56) References Cited

U.S. PATENT DOCUMENTS

| | | | | | |
|---|---|---|---|---|---|
| 285,240 | A * | 9/1883 | Doyle | 49/323 |
| 894,495 | A * | 7/1908 | Graichen | 292/247 |
| 919,154 | A * | 4/1909 | Gen | 16/335 |
| 1,010,365 | A * | 11/1911 | Hensle | 292/302 |
| 1,497,879 | A * | 6/1924 | Richardson | 292/95 |
| 2,526,209 | A * | 10/1950 | Durup | 16/336 |
| 2,571,430 | A * | 10/1951 | Durup | 16/335 |
| 2,643,926 | A * | 6/1953 | Pucci | 108/131 |
| 2,709,631 | A * | 5/1955 | Covucci | 108/36 |
| 2,925,894 | A * | 2/1960 | Lee, Jr. et al. | 49/400 |
| 3,342,147 | A * | 9/1967 | Shettles | 108/64 |
| 3,368,504 | A * | 2/1968 | Cohen | 108/131 |
| 3,608,130 | A * | 9/1971 | Rudnick | 16/335 |
| 4,063,330 | A * | 12/1977 | Triplette | 16/321 |
| 4,841,877 | A * | 6/1989 | Virtue | 108/36 |
| 5,257,839 | A * | 11/1993 | Nielsen et al. | 292/113 |
| 5,357,872 | A * | 10/1994 | Wilmore | 108/35 |
| 6,041,721 | A * | 3/2000 | Weston | 108/65 |
| 6,058,853 | A * | 5/2000 | Pinch | 108/129 |
| 6,520,094 | B2 * | 2/2003 | Wen | 108/132 |
| 6,659,021 | B2 * | 12/2003 | Wen | 108/125 |
| 6,823,806 | B1 * | 11/2004 | Buono | 108/132 |

(Continued)

*Primary Examiner*—Darnell M Jayne
*Assistant Examiner*—Timothy M Ayres
(74) *Attorney, Agent, or Firm*—Luedeka, Neely & Graham, P.C.

(57) ABSTRACT

A latching system for a foldable table having two tabletop halves each having a bottom surface and an end surface includes a receiver disposed on the end surface of the first tabletop half and a latching mechanism disposed on the end surface of the second tabletop half. The latching mechanism has an L-shaped anchor and a pivoting clasp. A bottom leaf of the anchor is fastened to the bottom of the second tabletop half and an end leaf of the anchor is fastened to the end surface of the second tabletop half with a plurality of fasteners. The anchor and clasp have one or more hinge barrels for receiving the hinge pin so that the hinged clasp pivots about the hinge pin relative to the anchor. The hinged clasp detachably mates with the receiver and thereby latches the two tabletop halves in a storage position.

6 Claims, 12 Drawing Sheets

U.S. PATENT DOCUMENTS 6,905,015 B2 * 6/2005 Hernandez et al. ..... 206/45.24
2002/0092445 A1 * 7/2002 Glover et al. ..... 108/129
2003/0010783 A1 * 1/2003 Prezelin ..... 220/324
2003/0038142 A1 * 2/2003 Gee ..... 220/835

* cited by examiner

LATCHING MECHANISM FOR FOLDABLE TABLE

CROSS REFERENCE TO RELATED APPLICATIONS

This application claims priority as a continuation-in-part to U.S. patent application Ser. No. 11/383,776 filed May 17, 2006 now abandoned titled FOLDABLE TABLE which is a continuation-in-part of U.S. patent application Ser. No. 10/763,155 filed Jan. 21, 2004 now abandoned titled FOLDABLE TABLE which is now abandoned.

FIELD

The present invention relates to a foldable table, and more particularly to a foldable table that is folded in half when not in use, thereby saving space of storage, package and transportation.

BACKGROUND AND SUMMARY

A conventional table is available for providing a support effect, thereby facilitating the user using the table. However, the conventional table has a fixed structure and cannot be folded when not in use, thereby increasing space of storage, and thereby causing inconvenience in storage, package and transportation.

The primary objective of the present invention is to provide a foldable table that is supported rigidly and stably when being expanded and is folded when not in use, thereby enhancing the versatility of foldable table.

Another objective of the present invention is to provide a foldable table, wherein the handle is pivoted outward to protrude from the two table boards, thereby facilitating the user carrying the foldable table.

A further objective of the present invention is to provide a foldable table that is folded when not in use, thereby saving space of storage, package and transportation.

In accordance with the present invention, there is provided a foldable table, comprising two table boards pivotally connected with each other, and two support units each foldably mounted on a respective one of the two table boards, wherein:

each of the two table boards has a bottom formed with a receiving space; and each of the support units is mounted in the receiving space of a respective one of the two table boards and includes a support stand having an end pivotally mounted on a first end of the respective table board, and a support member pivotally mounted on a second end of the respective table board and pivotally connected with the support stand.

In preferred embodiments, the invention provides a collapsible table having an elongate blow-molded tabletop. The tabletop includes two table boards, also referred to herein as a first tabletop half and a second tabletop half. Each half has a substantially planar top surface and a bottom surface opposite the top surface. Attached to the bottom surface of the tabletop is a support frame comprising first and second pairs of support members. The first pair of support members is disposed adjacent outer edges of the bottom surface of the first tabletop half, and the second pair of support members is disposed adjacent outer edges of the bottom surface of the second tabletop half. A pair of hinge assemblies pivotally connect the first pair of support members to the second pair of support members so that the first tabletop half is pivotally connected to the second tabletop half. This allows the first and second tabletop halves to be folded together in a storage configuration.

In some preferred embodiments, a latching system temporarily latches together tabletop halves of a collapsible table, where the collapsible table includes a first tabletop half and a second tabletop half. The tabletop halves each have a substantially planar top surface, a bottom surface opposite the top surface, an end surface, and a support frame attached to the bottom surface of the tabletop. The support frame includes a first pair of support members disposed adjacent outer edges of the bottom surface of the first tabletop half and a second pair of support members disposed adjacent outer edges of the bottom surface of the second tabletop half. The support frame also includes at least one hinge assembly for pivotally connecting the first tabletop half to the second tabletop half, thereby allowing the first and second tabletop halves to be folded together in a storage position.

The latching system includes a receiver disposed on the end surface of the first tabletop half. A latching mechanism is disposed on the second tabletop half and detachably engages the receiver when the collapsible table is in the storage position. The latching mechanism includes a hinge pin and a hinged clasp having at least one clasp barrel for receiving the hinge pin such that the hinged clasp is operable to pivot about the hinge pin and detachably engage the receiver. Also, the latching mechanism includes a substantially L-shaped anchor attached to the second tabletop half. The anchor has a bottom leaf, an end leaf which is substantially perpendicular to the bottom leaf, and at least one anchor barrel for receiving the hinge pin such that the hinged clasp is pivotally engaged with the anchor.

In some preferred embodiments, a collapsible table includes an elongate tabletop formed from blow-molded plastic, a support frame attached to the tabletop, at least one hinge assembly, and a latching system. The elongate tabletop includes a first tabletop half and a second tabletop half. Each tabletop half has a substantially planar top surface, an end surface, and a bottom surface opposite the top surface. The support frame is attached to the bottom surface of the tabletop and includes a first pair of support members disposed adjacent outer edges of the bottom surface of the first tabletop half and a second pair of support members disposed adjacent outer edges of the bottom surface of the second tabletop half. At least one hinge assembly pivotally connects the first tabletop half to the second tabletop half, thereby allowing the first and second tabletop halves to be folded together in a storage position.

The latching system includes a receiver, a latching mechanism, a hinge pin, a hinged clasp, and a substantially L-shaped anchor. The receiver is disposed on the end surface of the first tabletop half and the latching mechanism is disposed on the second tabletop half for detachably engaging the receiver when the collapsible table is in the storage position. The latching mechanism includes a hinge pin and a hinged clasp having at least one clasp barrel for receiving the hinge pin such that the hinged clasp is operable to pivot about the hinge pin and detachably engage the receiver. The latching mechanism also includes a substantially L-shaped anchor attached to the second tabletop half. The anchor has a bottom leaf and an end leaf which is substantially perpendicular to the bottom leaf. The anchor also has at least one anchor barrel for receiving the hinge pin such that the hinged clasp is pivotally engaged with the anchor.

Further benefits and advantages of the present invention will become apparent after a careful reading of the detailed description with appropriate reference to the accompanying drawings.

BRIEF DESCRIPTION OF THE DRAWINGS

Further advantages of the invention are apparent by reference to the detailed description in conjunction with the figures, wherein elements are not to scale so as to more clearly show the details, wherein like reference numbers indicate like elements throughout the several views, and wherein.

DETAILED DESCRIPTION

Figure 1:
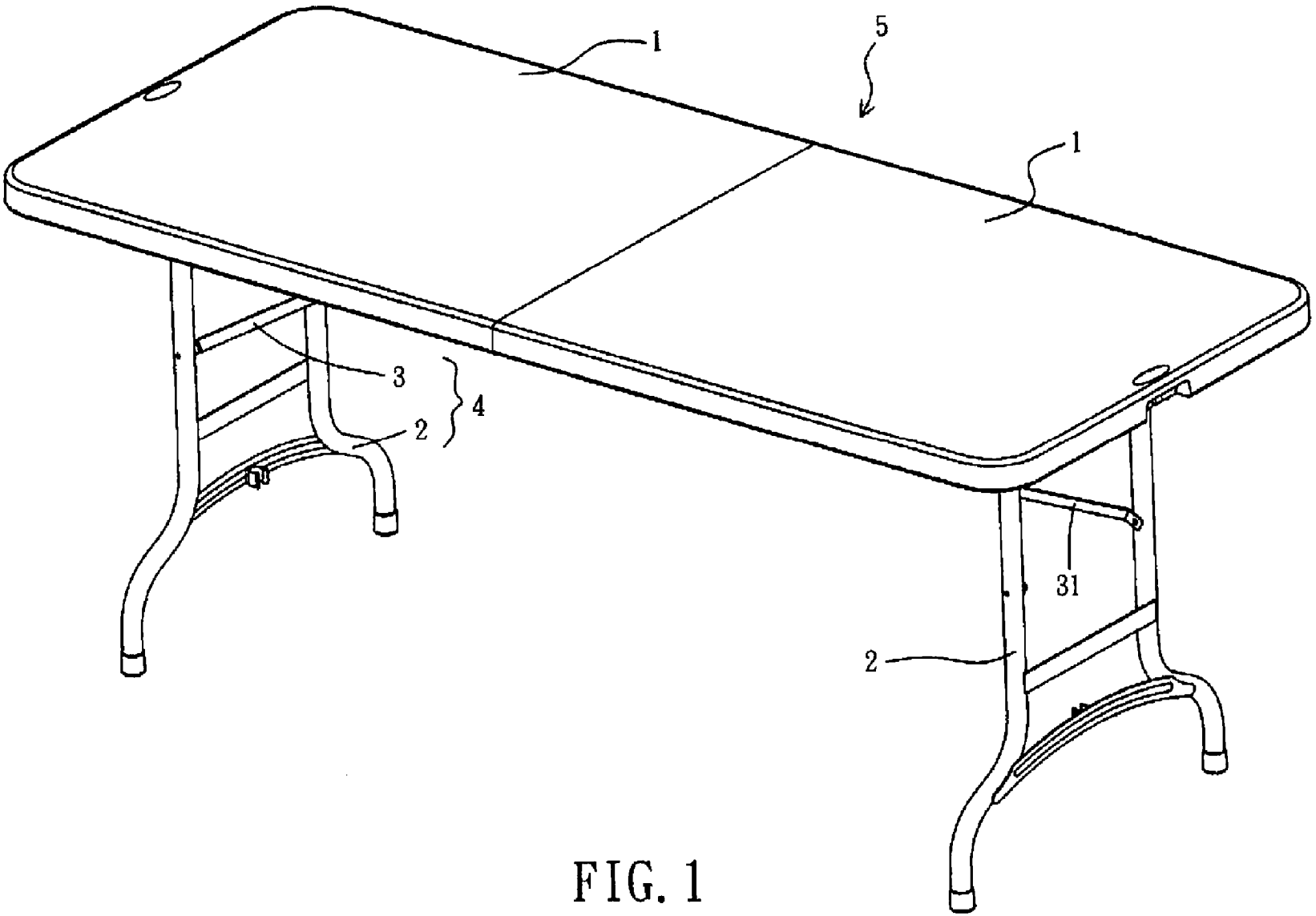
FIG. 1 is a perspective view of a foldable table in accordance with one embodiment of the present invention.
Figure 2:
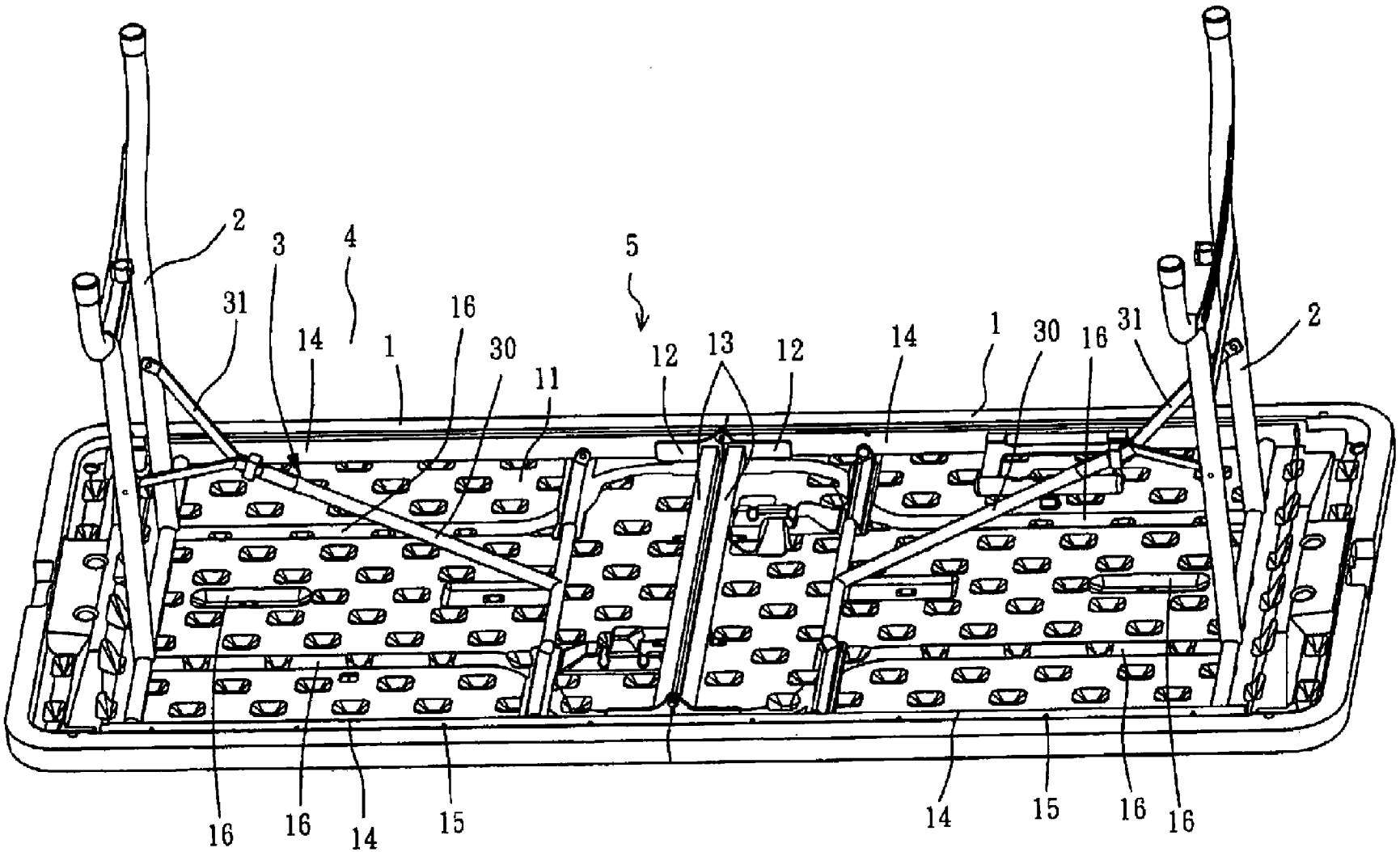
FIG. 2 is a bottom perspective view of the foldable table as shown in FIG. 1.
Figure 3:
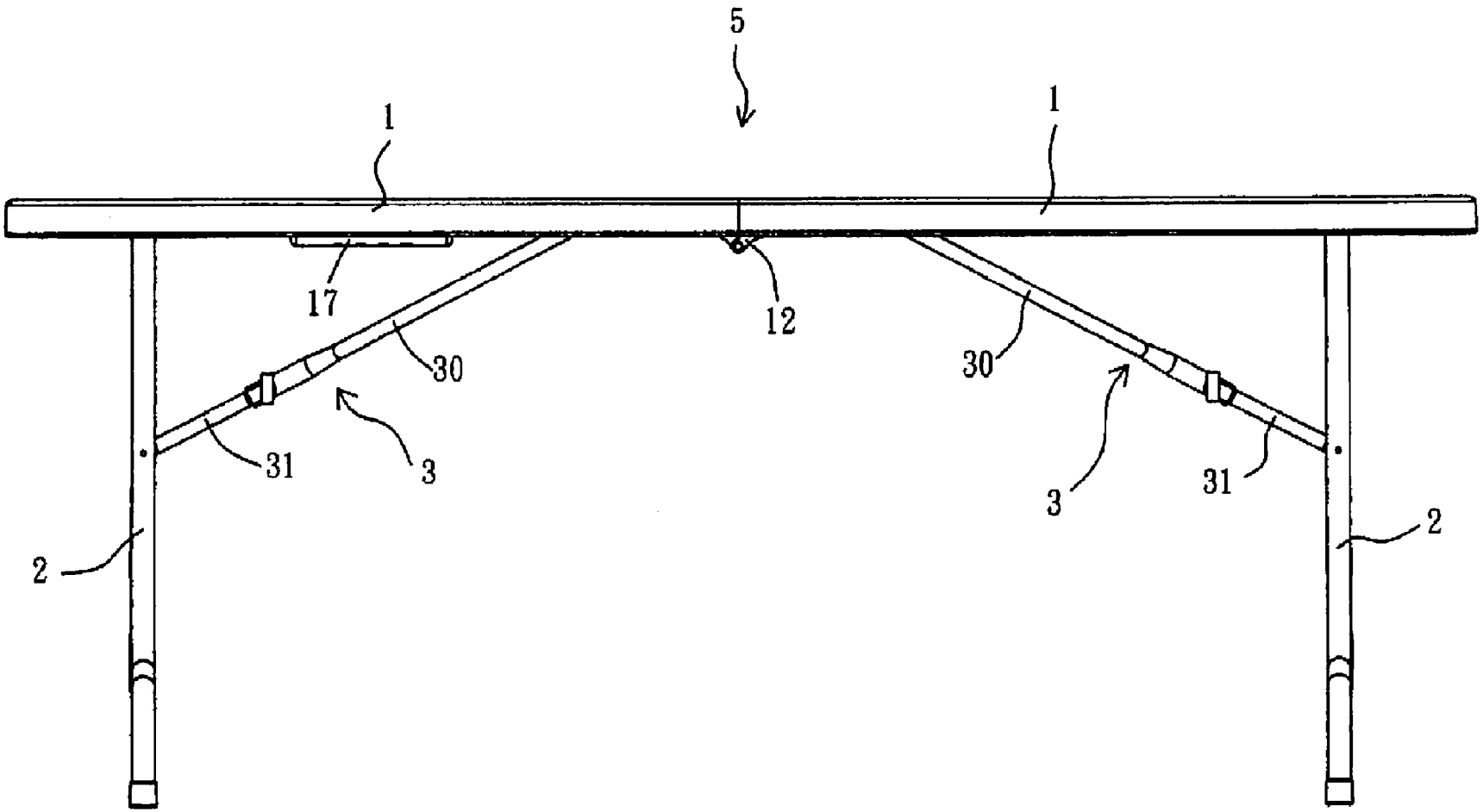
FIG. 3 is a front plan view of the foldable table as shown in FIG. 1.
Figure 4:
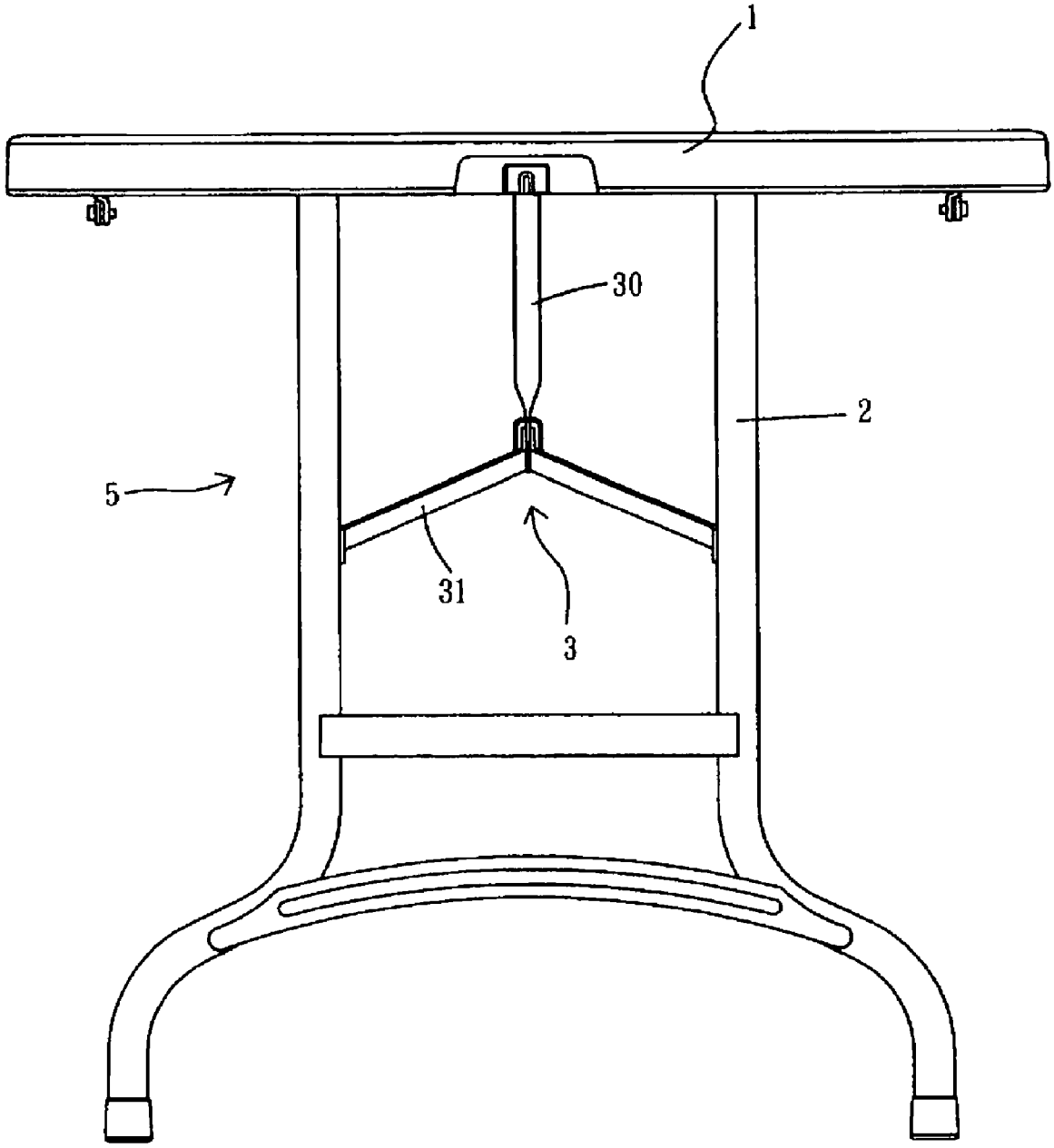
FIG. 4 is a side plan view of the foldable table as shown in FIG. 1.

Referring to the drawings and initially to FIGS. 1-8, a foldable table 5 in accordance with the preferred embodiment of the present invention comprises two table boards 1 pivotally connected with each other, and two support units 4 each foldably mounted on a respective one of the two table boards 1. The table boards 1 are also referred to herein as tabletop halves 1.

Figure 6:
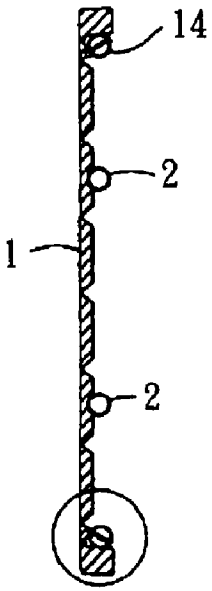
FIG. 6 is a plan cross-sectional view of the foldable table taken along line 6-6 as shown in FIG. 5.
Figure 8:
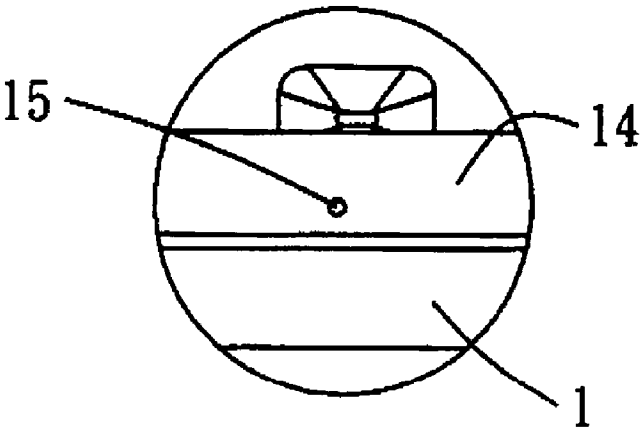
FIG. 8 is a partially enlarged view of the foldable table as shown in FIG. 5.
Figure 7:
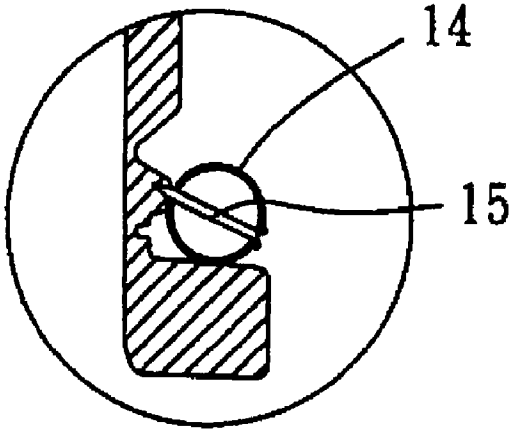
FIG. 7 is a partially enlarged view of the foldable table as shown in FIG. 6.
Figure 9:
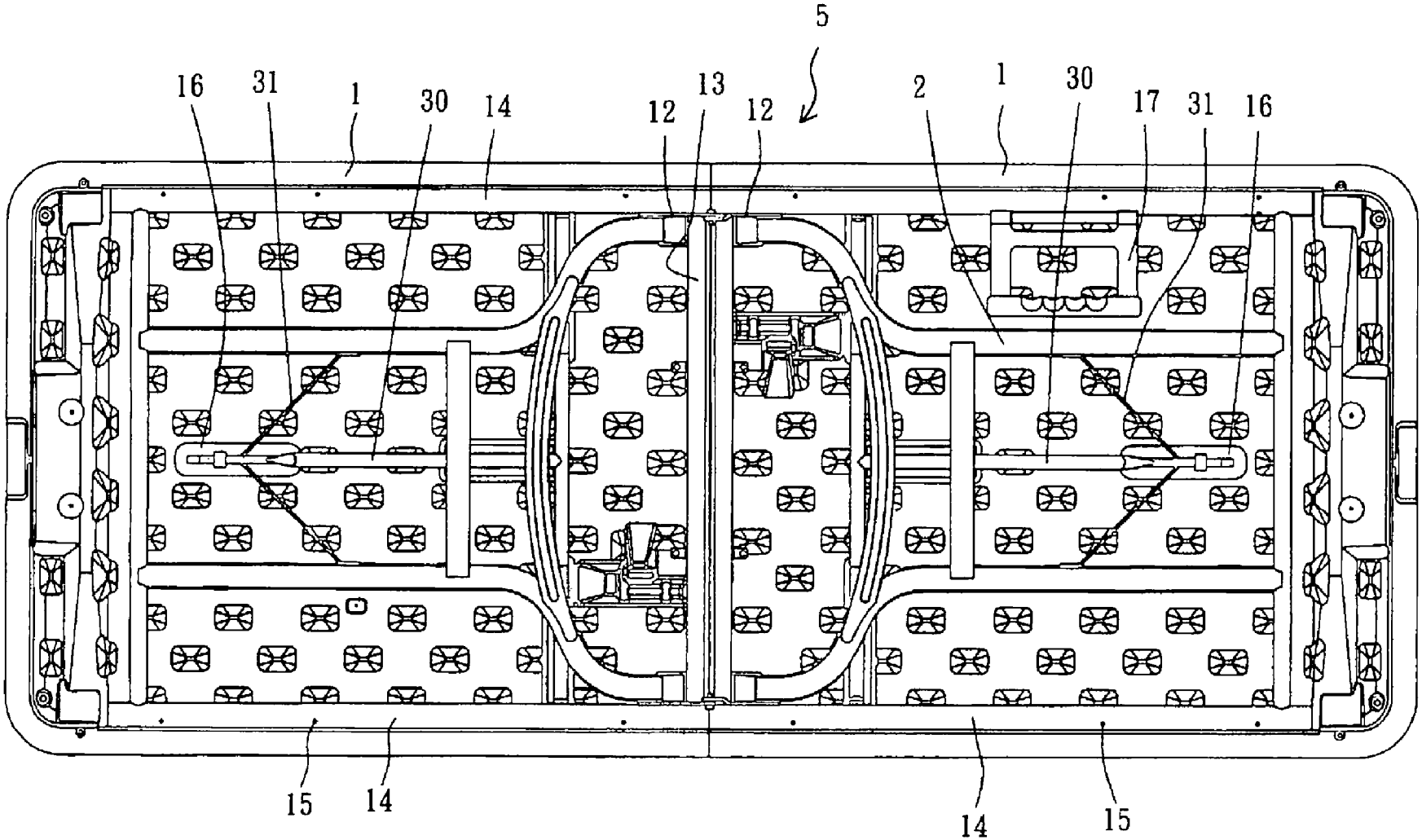
FIG. 9 is a partially enlarged view of the foldable table as shown in FIG. 5.

The two tabletop halves 1 are pivotally connected with each other by two pivot members 12. Each of the two tabletop halves 1 has a bottom formed with a receiving space 11. The foldable table further comprises two juxtaposed reinforcement members 13 each secured on an edge of a respective one of the two tabletop halves 1. The receiving space 11 of each of the two tabletop halves 1 has two sides each provided with a support tube 14 secured on each of the two tabletop halves 1 by a plurality of screws 15 as shown in FIGS. 6-8.

Each of the support units 4 is mounted in the receiving space 11 of a respective one of the two tabletop halves 1 and includes a support stand 2 having an end pivotally mounted on a first end of the respective table board 1, and a support member 3 pivotally mounted on a second end of the respective table board 1 and pivotally connected with the support stand 2.

The support member 3 of each of the support units 4 includes a substantially T-shaped support bar 30 having a first end pivotally mounted on the second end of the respective table board 1, and a substantially V-shaped extension bar 31 having a first end pivotally mounted on a second end of the support bar 30 and a second end pivotally mounted on a mediate portion of the support stand 2.

The receiving space 11 of each of the two tabletop halves 1 is formed with a plurality of receiving recesses 16 for receiving the support stand 2 and the support member 3 of each of the support units 4 when being folded.

Figure 5:
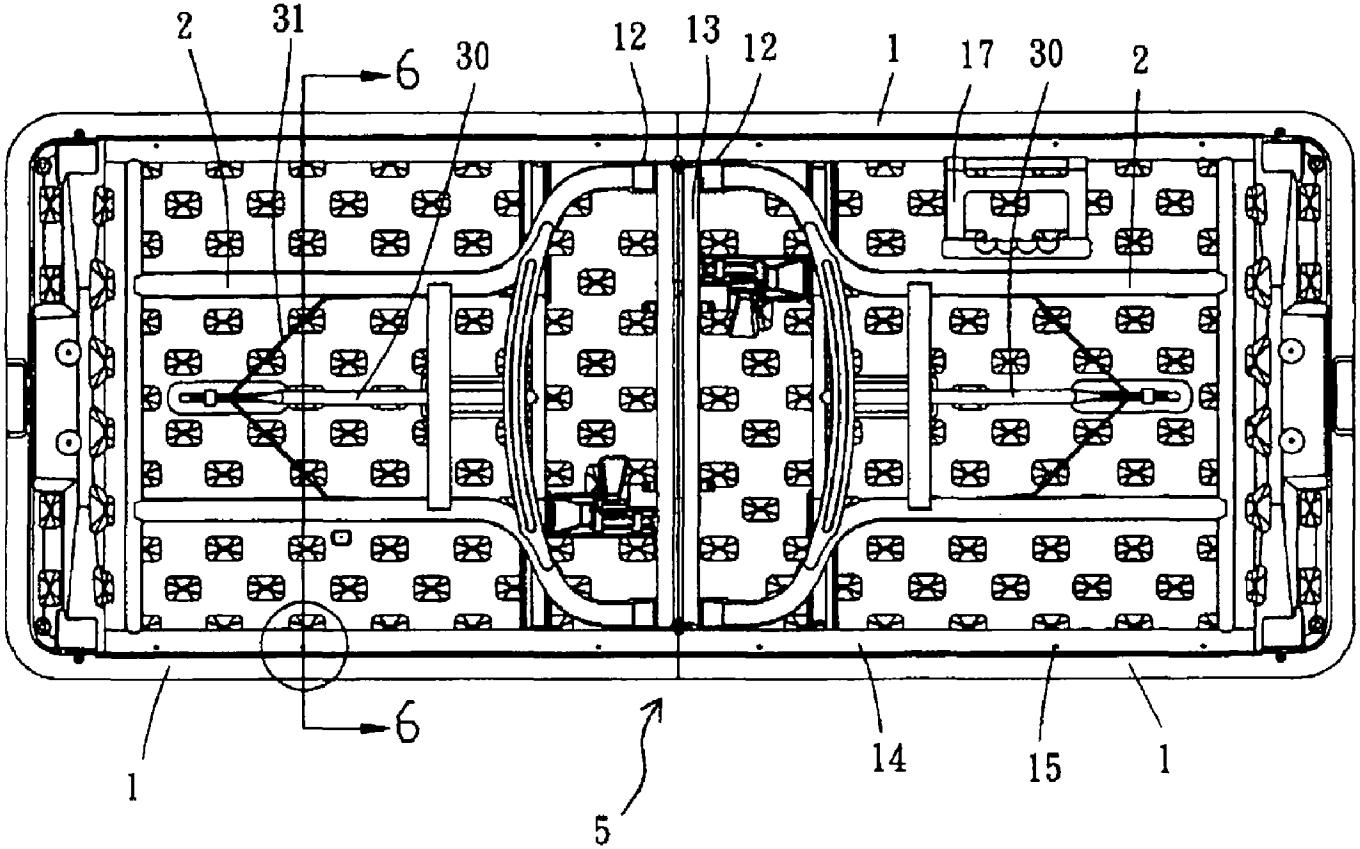
FIG. 5 is a bottom plan folded view of the foldable table as shown in FIG. 1.

As shown in FIG. 5, the foldable table 5 further comprises a handle 17 pivotally mounted on either one of the two tabletop halves 1.

In practice, as shown in FIGS. 1-4, the support stand 2 of each of the support units 4 is pulled outward relative to the respective table board 1 to drive the support member 3 to extend outward, thereby fully stretching the support member 3, so that the two tabletop halves 1 are supported by the support units 4 rigidly and stably, thereby fully expanding the foldable table 5 as shown in FIG. 1.

Figure 10:
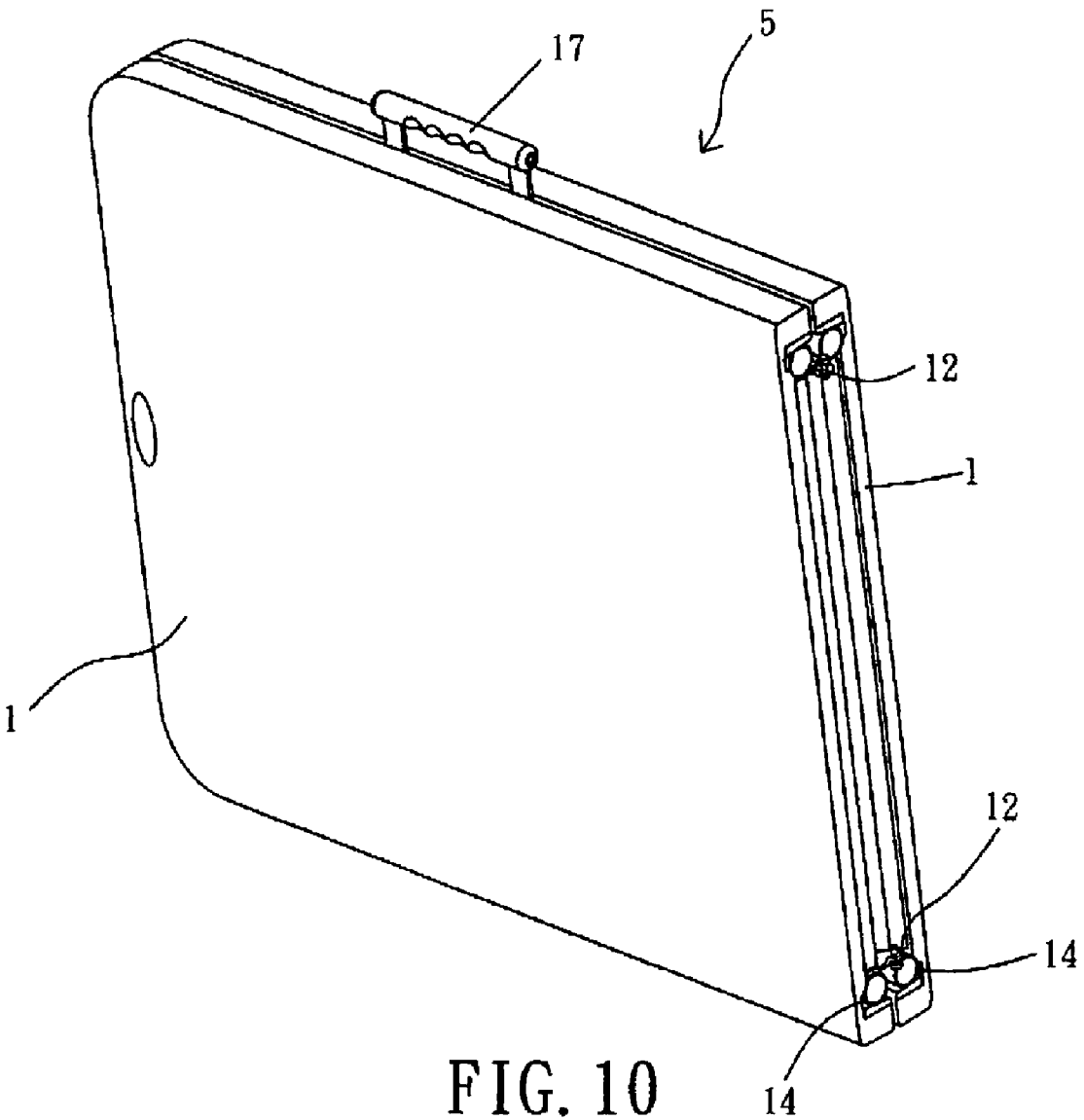
FIG. 10 is a perspective folded view of the foldable table in accordance with one embodiment of the present invention.

As shown in FIGS. 5-10, when the user wishes to fold the foldable table 5, the support stand 2 of each of the support units 4 is pressed toward the respective table board 1 to drive the support member 3 to move and pivot inward, thereby folding the support member 3 and the support stand 2 into the receiving recesses 16 of the respective table board 1, so that the two tabletop halves 1 are pivoted relative to each other, thereby folding the foldable table 5 as shown in FIG. 10. At this time, the handle 17 is pivoted outward to protrude from the two tabletop halves 1, thereby facilitating the user carrying the foldable table 5.

Figure 11:
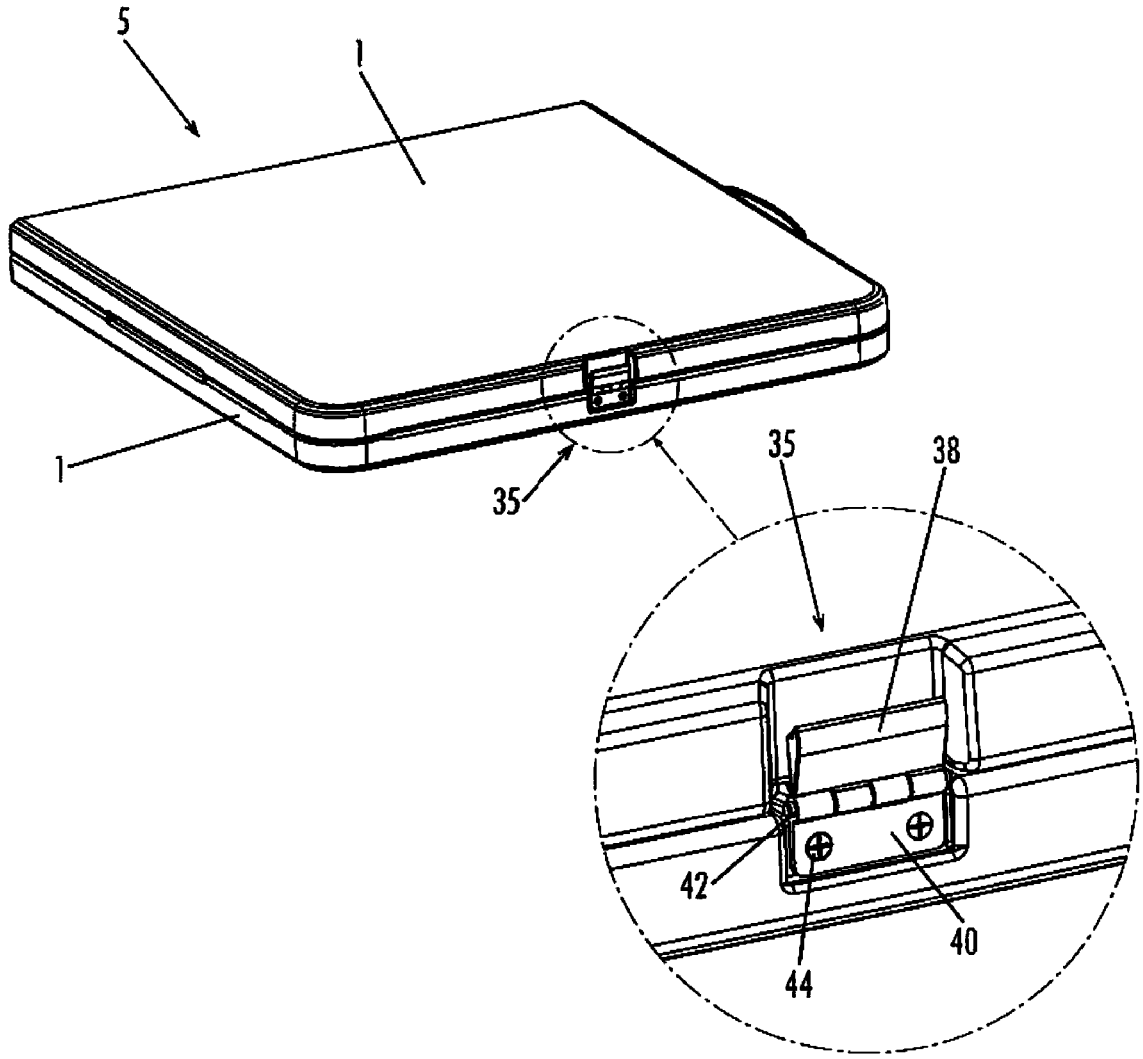
FIG. 11 depicts a foldable table having a latching system according to a preferred embodiment of the invention.
Figure 12:
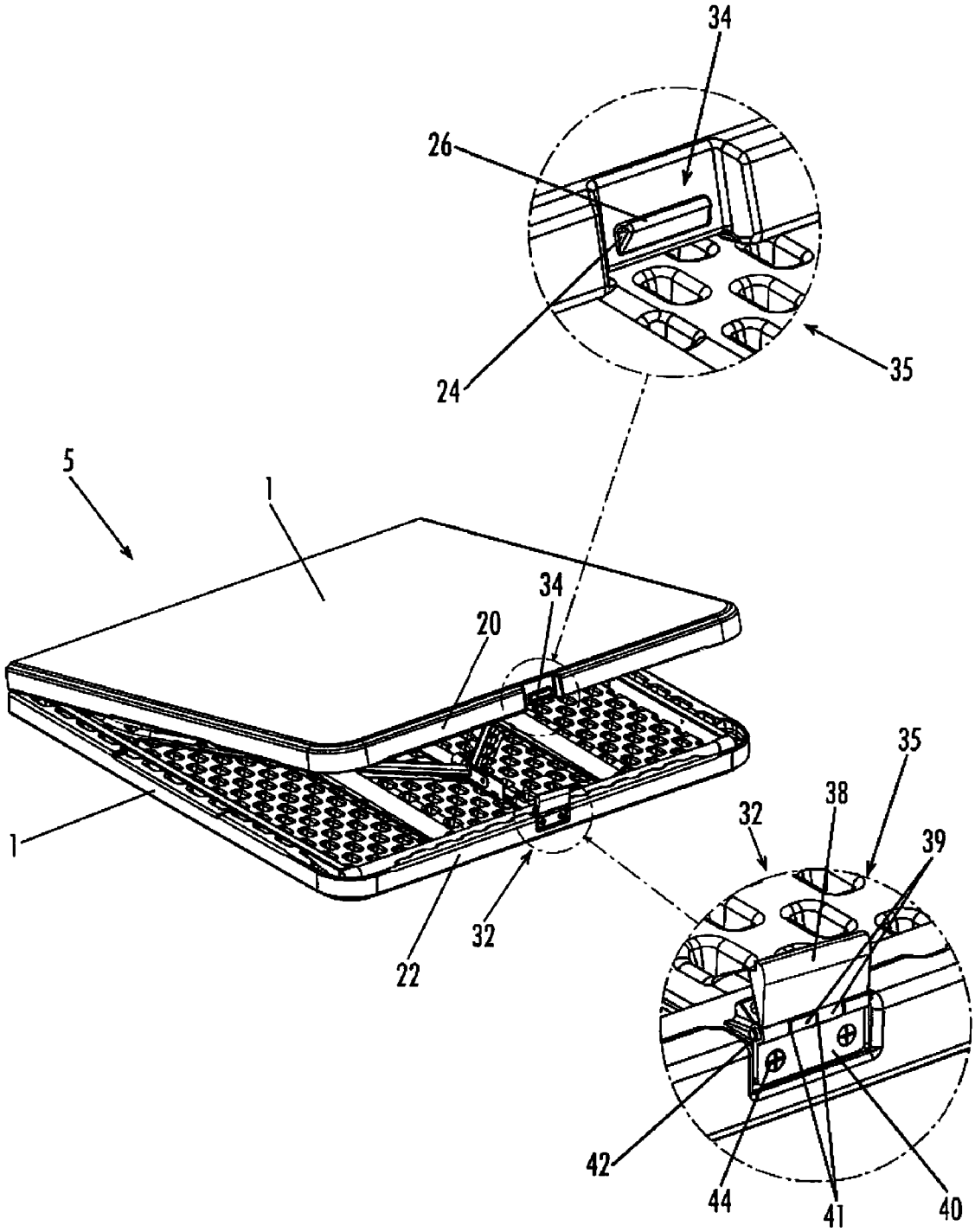
FIG. 12 depicts the latching system of FIG. 11 in a storage position.
Figure 13:
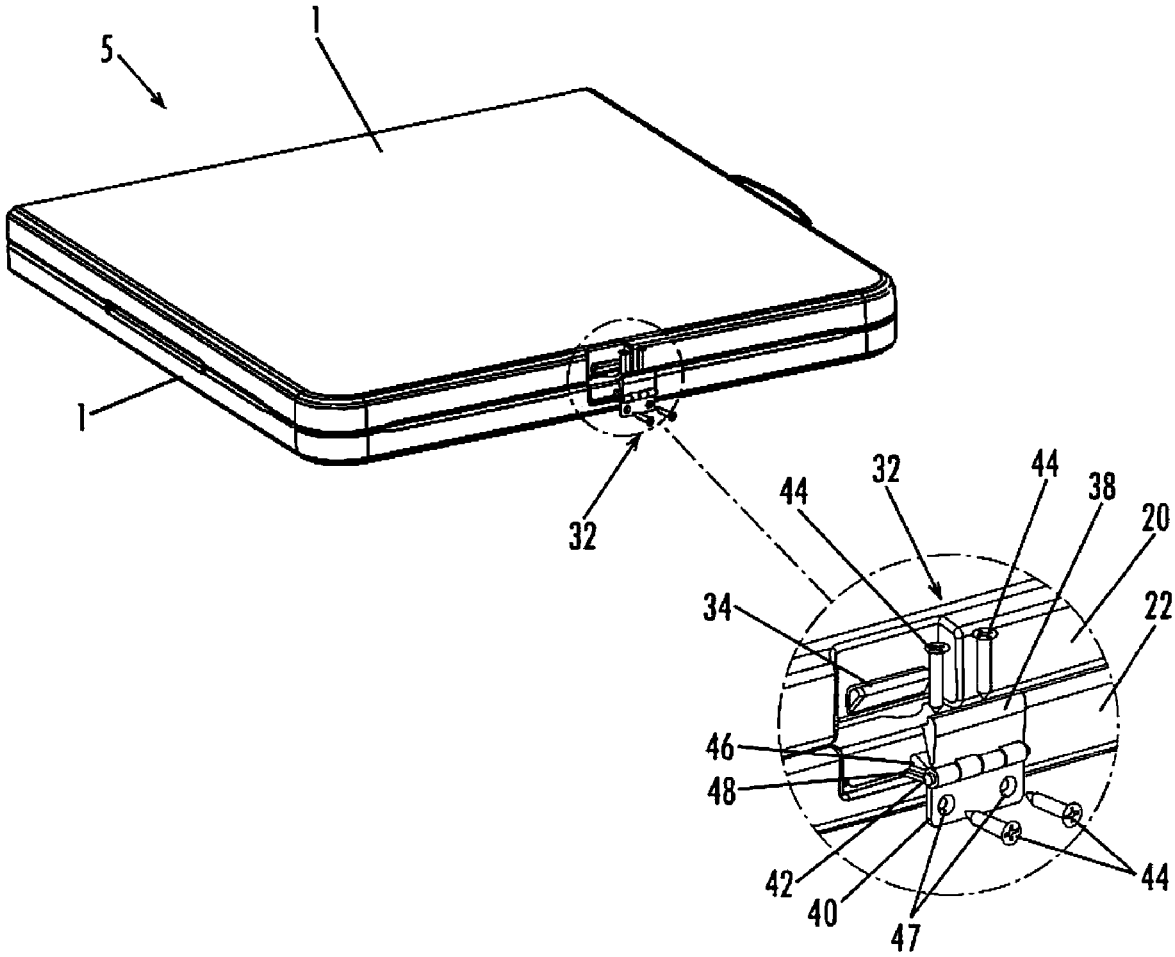
FIG. 13 is a partially exploded view of the latching system of FIG. 11.

FIGS. 11 through 13 depict an embodiment of the invention wherein the foldable table 5 includes a latching system 35 having a receiver 34 and a latching mechanism 32. The latching mechanism 32 detachably mates with the receiver 34 and thereby latches the two tabletop halves 1 in a storage configuration (also referred to as a "storage position" or a "latched position") facilitating storing or carrying. The receiver 34 is located on an end surface 20 of the first tabletop half 1. The latching mechanism 32 is located opposite receiver 34 on an end surface 22 of the second tabletop half 1 opposite the end surface 20 of the first tabletop half 1. In some embodiments, the receiver 34 is formed as an integral part of the first tabletop half 1. For example, it may be made of blow molded plastic and formed during the molding of the first tabletop half 1. The receiver 34 comprises an elongate protrusion 24 substantially shaped like a right-triangular prism having a rounded wing 26 extending from a side of the elongate protrusion 24 in a direction substantially parallel to the end surface 20 of the tabletop half 1. The rounded wing 26 detachably mates with a hinged clasp 38 of the latching mechanism 32.

In some embodiments, the hinged clasp 38 includes a pair of substantially parallel clasp hinge barrels 39 each having a clasp hinge barrel aperture. The clasp hinge barrel apertures receive a hinge pin 42 such that the clasp hinge barrels 39 may pivot about the hinge pin 42. Similarly, an anchor 40 includes a pair of substantially parallel anchor hinge barrels 41, each having an anchor hinge barrel aperture for receiving the hinge pin 42 such that the anchor hinge barrels 41 may pivot about the hinge pin 42. The anchor hinge barrels 41 are interdigitated with the clasp hinge barrels 39, and the clasp barrel apertures are substantially aligned with the anchor barrel apertures. In other embodiments, different numbers of hinge barrels 39 and 41 are used, for example three clasp hinge barrels 39 and three anchor hinge barrels 41. In preferred embodiments, the anchor 40, pin 42 and hinged clasp 38 are formed of metal. However, it will be appreciated that the anchor 40, pin 42 and hinged clasp 38 may be formed of plastic or a composite structure.

Figure 14:
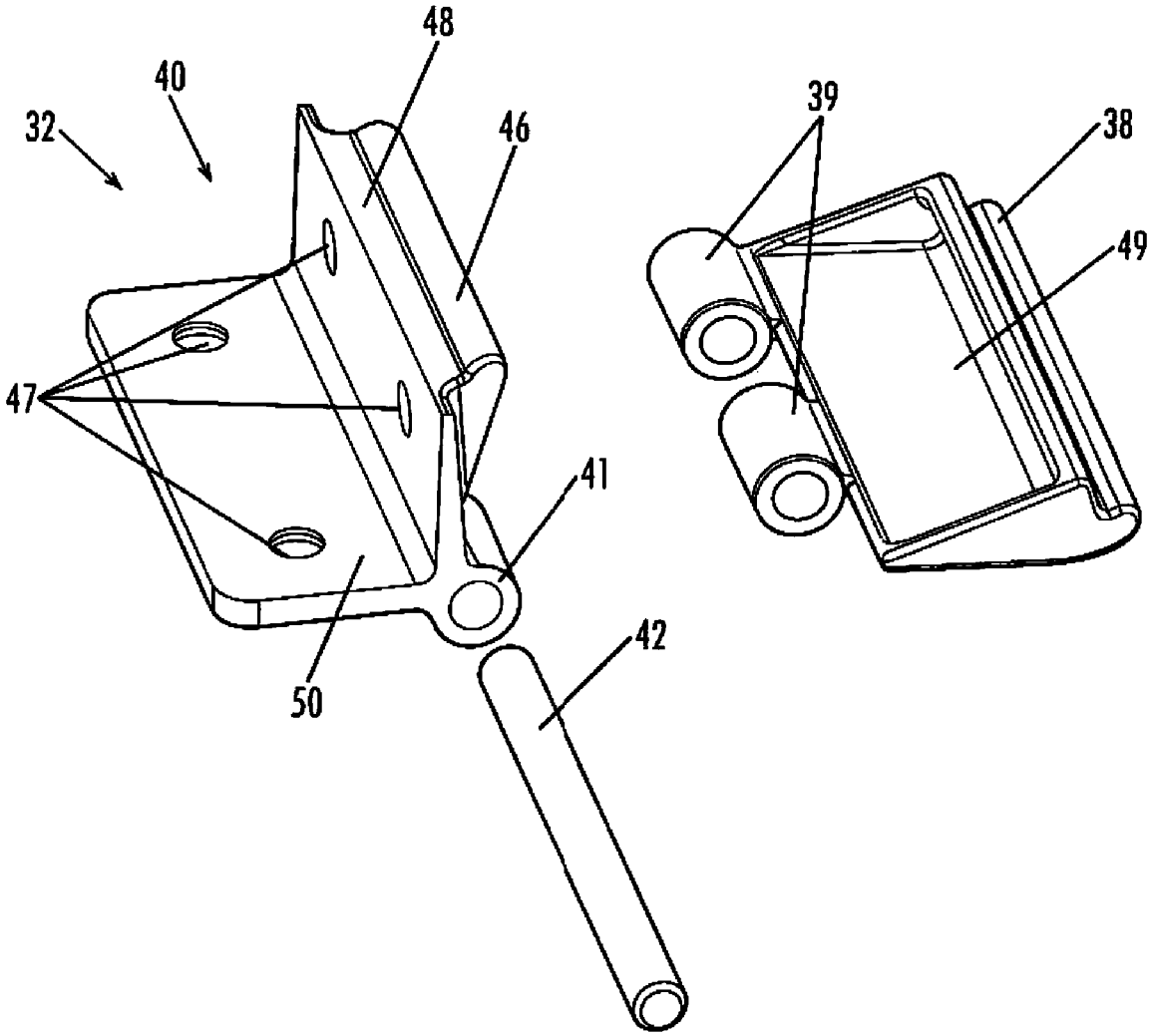
FIG. 14 is an enlarged view of components of the latching system of FIG. 11.

As illustrated in FIG. 14, anchor 40 is substantially L-shaped and has an end leaf 50 and a bottom leaf 48. Anchor 40 also has a plurality of fastener apertures 47 for receiving a plurality of fasteners 44 (FIGS. 11-13) for fastening anchor 40 to the second tabletop half 1. Referring now to FIG. 11, the foldable table 5 is shown in a storage position or configuration wherein the latching mechanism 32 and the receiver 34 are detachably mated. In this configuration, hinged clasp 38 has been secured over receiver 34. As shown in FIG. 14, the hinged clasp 38 has a cavity 49 having an inner shape substantially mirroring the outer surface of receiver 34, specifically including rounded wing 26 such that hinged clasp 38 detachably mates with receiver 34 when moved into the latched configuration of FIG. 11.

FIGS. 13 and 14 provide detailed illustrations of the latching mechanism 32. As discussed above, anchor 40 of latching mechanism 32 is secured to the second tabletop half 1 by fasteners 44 which pass through apertures 47. The bottom leaf 48 of anchor 40 has an anchor receiver 46 shaped similarly to receiver 34. The anchor receiver 46 receives hinged clasp 38 when the table 5 is in an open configuration such as that shown in FIGS. 1-9. In such a configuration, the anchor receiver 46 detachably mates with hinged clasp 38 so that the clasp 38 does not hang down from table 5. This prevents the clasp 38 from potentially encroaching on leg space underneath table 5 while the table 5 is in use.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A latching system configured for temporarily latching together tabletop halves of a collapsible table, where the collapsible table comprises an elongate tabletop comprising a first tabletop half and a second tabletop half, the first and second tabletop halves each having a substantially planar top surface, a bottom surface opposite the top surface, an end surface, a support frame attached to the bottom surface of the tabletop, the support frame comprising a first pair of support members disposed adjacent outer edges of the bottom surface of the first tabletop half and a second pair of support members disposed adjacent outer edges of the bottom surface of the second tabletop half, at least one hinge assembly for pivotally connecting the first tabletop half to the second tabletop half, thereby allowing the first and second tabletop halves to be folded together in a storage position, the latching system comprising:

a receiver configured to be disposed on the end surface of the first tabletop half; and a latching mechanism configured to be disposed on the second tabletop half and configured for detachably engaging the receiver when the collapsible table is in the storage position, the latching mechanism comprising:

a hinge pin;

a hinged clasp having at least one clasp barrel for receiving the hinge pin such that the hinged clasp is operable to pivot about the hinge pin and detachably engage the receiver; and a substantially L-shaped anchor configured to be attached to the second tabletop half, the anchor having a bottom leaf, an end leaf which is substantially perpendicular to the bottom leaf, and at least one anchor barrel for receiving the hinge pin such that the hinged clasp is pivotally engaged with the anchor, wherein the bottom leaf of the anchor includes an anchor receiver configured for receiving the hinged clasp when the hinged clasp is not engaged with the receiver, wherein the anchor receiver comprises an elongate protrusion substantially in the shape of a triangular prism having a first and a second elongate surface, the first elongate surface having a rounded wing extending from it in a direction substantially parallel to the bottom leaf of the anchor.

2. The latching system of claim 1 wherein the receiver is configured to be an integral part of the first tabletop half.

3. The latching system of claim 1 wherein the receiver is formed of blow-molded plastic and is configured to beas an integral part of a first tabletop half formed of blow-molded plastic.

4. The latching system of claim 1 wherein the receiver comprises an elongate protrusion substantially in the shape of a triangular prism having a first and a second elongate surface, the first elongate surface having a rounded wing extending from it.

5. The latching system wherein the hinged clasp defines a cavity shaped to engage the receiver of claim 4.

6. A collapsible table comprising:

an elongate tabletop formed from blow-molded plastic, the tabletop comprising a first tabletop half and a second tabletop half, the first and second tabletop halves each having a substantially planar top surface, an end surface, and a bottom surface opposite the top surface;

a support frame attached to the bottom surface of the tabletop, the support frame comprising a first pair of support members disposed adjacent outer edges of the bottom surface of the first tabletop half and a second pair of support members disposed adjacent outer edges of the bottom surface of the second tabletop half;

at least one hinge assembly for pivotally connecting the first tabletop half to the second tabletop half, thereby allowing the first and second tabletop halves to be folded together in a storage position; and a latching system comprising:

a receiver disposed on the end surface of the first tabletop half; and a latching mechanism disposed on the second tabletop half for detachably engaging the receiver when the collapsible table is in the storage position, the latching mechanism comprising:

a hinge pin;

a hinged clasp having at least one clasp barrel for receiving the hinge pin such that the hinged clasp is operable to pivot about the hinge pin and detachably engage the receiver; and a substantially L-shaped anchor attached to the second tabletop half, the anchor having a bottom leaf, an end leaf which is substantially perpendicular to the bottom leaf, and at least one anchor barrel for receiving the hinge pin such that the hinged clasp is pivotally engaged with the anchor.

* * * * *